US011533957B2

(12) United States Patent
Coccia et al.

(10) Patent No.: US 11,533,957 B2
(45) Date of Patent: Dec. 27, 2022

(54) PROTECTION DEVICE

(71) Applicant: KUKU SAGL, Lugano (CH)

(72) Inventors: Stefano Coccia, Conegliano (IT); Guido Zago, San Vendemiano (IT)

(73) Assignee: KUKU SAGL, Lugano (CH)

( * ) Notice: Subject to any disclaimer, the term of this patent is extended or adjusted under 35 U.S.C. 154(b) by 205 days.

(21) Appl. No.: 16/628,997

(22) PCT Filed: Jul. 4, 2018

(86) PCT No.: PCT/EP2018/068125
§ 371 (c)(1),
(2) Date: Jan. 6, 2020

(87) PCT Pub. No.: WO2019/008056
PCT Pub. Date: Jan. 10, 2019

(65) Prior Publication Data

US 2020/0121001 A1 Apr. 23, 2020

(30) Foreign Application Priority Data

Jul. 7, 2017 (IT) ..... 102017000076430

(51) Int. Cl.
*A41D 13/05* (2006.01)
*A41D 1/08* (2018.01)

(52) U.S. Cl.
CPC ..... *A41D 13/0568* (2013.01); *A41D 1/088* (2013.01); *A41D 13/0525* (2013.01)

(58) Field of Classification Search
None
See application file for complete search history.

(56) References Cited

U.S. PATENT DOCUMENTS 1,828,572 A * 10/1931 Lawrence ..... A41D 1/06 2/231
3,807,793 A * 4/1974 Jacobs ..... B62J 1/18 297/214

(Continued)

FOREIGN PATENT DOCUMENTS

CN 2064986 U 11/1990
CN 201263407 Y 7/2009

(Continued)

OTHER PUBLICATIONS

International Search Report dated Sep. 5, 2018 re: Application No. PCT/EP2018/068125, pp. 1-3, citing: WO 2016/038640 A1, US 2017/135420 A1 and CN 201 263 407 Y.

(Continued)

*Primary Examiner* — Jocelyn Bravo
(74) *Attorney, Agent, or Firm* — Cantor Colburn LLP

(57) ABSTRACT

A protection device for the ischial, perineal and urogenital area of a user, comprising:

a folding main body, which is shaped substantially like a parallelogram and the internal surface of which is stably associated with multiple paddings which are separated by a plurality of dividing segments, two elastically extendable straps, which are stably associated at a first end thereof with the main body, at least one element for temporary interconnection, which is associated detachably with a second end of one of the straps.

8 Claims, 6 Drawing Sheets

(56) References Cited

U.S. PATENT DOCUMENTS

| | | | | | |
|---|---|---|---|---|---|
| 4,229,835 | A * | 10/1980 | Shaw | A41B 9/001 | 2/221 |
| 4,805,243 | A * | 2/1989 | Gibbens | A41D 1/084 | 2/228 |
| 4,837,859 | A * | 6/1989 | Hamberg | A41D 13/0537 | 2/1 |
| 5,241,706 | A * | 9/1993 | Netz | A41D 13/0537 | 2/267 |
| 5,623,735 | A * | 4/1997 | Perry | A41F 3/00 | 2/326 |
| 6,988,281 | B1 * | 1/2006 | Jerome | A41D 13/0568 | 2/24 |
| 2001/0052146 | A1 * | 12/2001 | Garneau | A41D 1/084 | 2/455 |
| 2005/0210570 | A1 * | 9/2005 | Garneau | A41D 13/0537 | 2/466 |
| 2006/0137071 | A1 * | 6/2006 | Rampersad | A41D 13/0556 | 2/24 |
| 2007/0174953 | A1 * | 8/2007 | Garneau | A41D 1/084 | 2/466 |
| 2011/0083254 | A1 * | 4/2011 | Trutna | A41F 1/002 | 2/326 |
| 2013/0000025 | A1 * | 1/2013 | Garneau | A41D 1/084 | 2/466 |
| 2014/0033394 | A1 * | 2/2014 | Stauffer | A45F 5/02 | 2/69 |
| 2014/0201888 | A1 * | 7/2014 | Bookbinder | A42B 7/00 | 2/338 |
| 2017/0135420 | A1 | 5/2017 | Peng | | |
| 2017/0202278 | A1 * | 7/2017 | Hazlewood | A41D 13/0568 | |

FOREIGN PATENT DOCUMENTS

| | | | |
|---|---|---|---|
| CN | 204393431 | U | 6/2015 |
| EP | 1179302 | A2 | 2/2002 |
| EP | 3190909 | A1 | 7/2017 |
| WO | 2013002262 | A1 | 1/2013 |
| WO | 2015033364 | A1 | 3/2015 |
| WO | 2016038640 | A1 | 3/2016 |

OTHER PUBLICATIONS

IT Search Report dated Feb. 15, 2018 re: Application No. IT 2017000076430, pp. 1-8, citing: WO 2016/038640 A1, US 2017/135420 A1 and CN 201 263 407 Y.

Written Opinion dated Sep. 5, 2018 re: Application No. PCT/EP2018/068125, pp. 1-5, citing: WO 2016/038640 A1.

CN Office Action dated Nov. 22, 2021 re: Application No. 201880045396.8, pp. 1-10, citing: CN204393431U and CN2064986U.

* cited by examiner

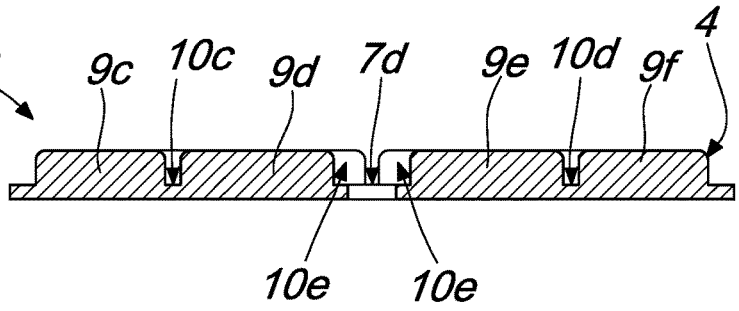
Fig. 4
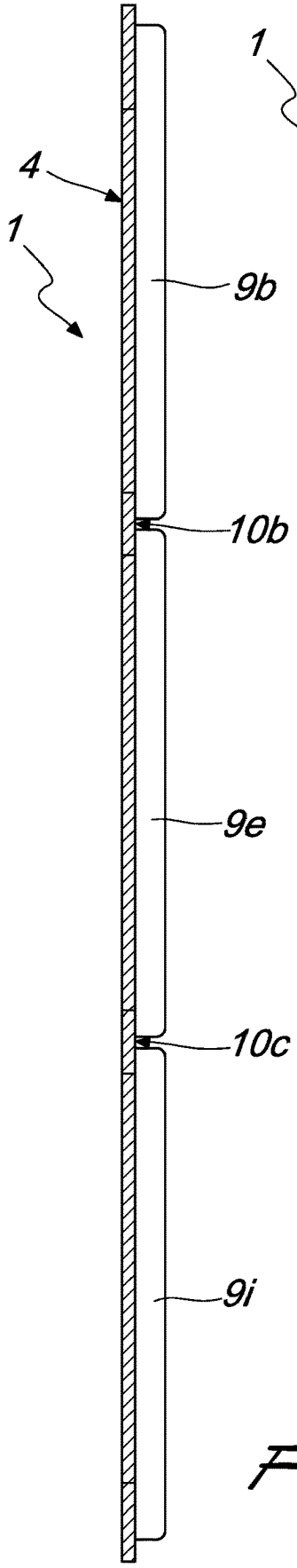
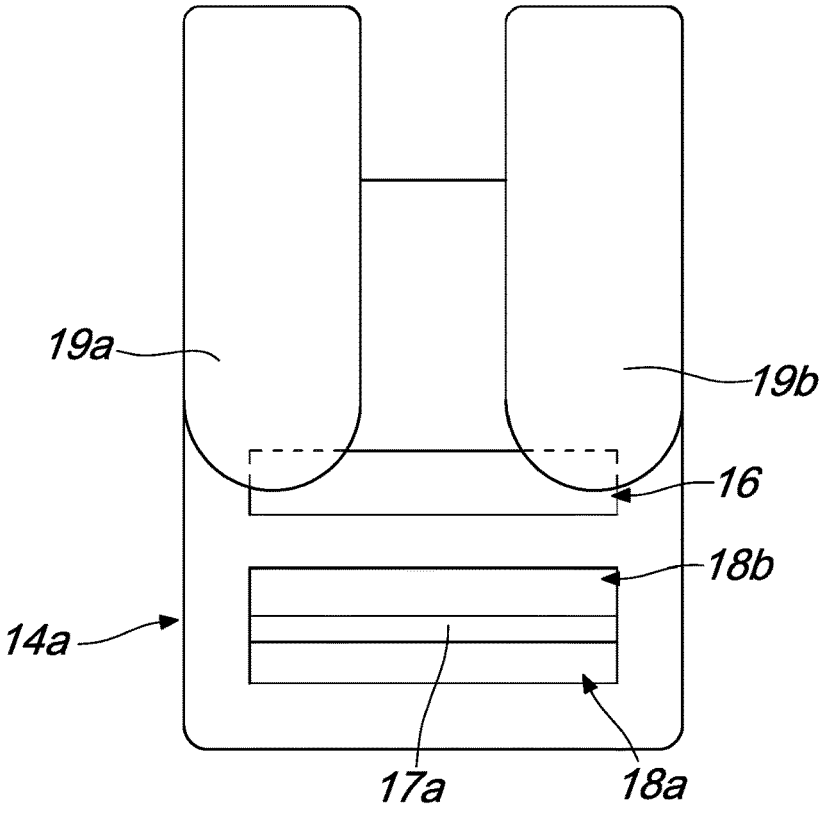
Fig. 6
Fig. 5

PROTECTION DEVICE

TECHNICAL FIELD

The present disclosure relates to a protection device, particularly for the ischial, perineal and urogenital area of the human body and which has a use in particular for sports, urban and/or tourism use such as, for example, cycling, mountain biking, motorcycling or even for other activities such as gymnastics, spinning, triathlon, the protection device being adapted for any type of saddle, seat, and chair, including for example of the type used in aircraft or in cars or, in general, in vehicles.

BACKGROUND

In the practice of cycling it is known to use pairs of shorts, made of partially elasticized material, constituted by a base support made of fabric to which a padding of adequate and uniform thickness is applied internally, at the ischial, perineal and urogenital area, for example by way of stitching or heat-taping or gluing, and is adapted to protect such area of the athlete: in fact during races or training this is the part of the body that remains continuously in contact with the saddle and is subjected to all the stresses due to the bumps and holes in the terrain and the vibrations transmitted by the bicycle frame as well as being subjected to continuous chafing.

Such continual stresses result in the onset of localized inflammation that can deteriorate into cuts or blisters that make practicing the sport difficult, if not impossible.

Such solution has drawbacks, however, since even if the thickness of the padding may initially give relief it has been found that the padding tends both to overheat the ischial, perineal and urogenital area and also to slide, thus also creating further conditions of discomfort, partly owing to sweating.

Furthermore, during use, such padding is subjected to shifts, making it necessary to correctly reposition it at the ischial, perineal and urogenital area; such repositioning is difficult however in that, such padding being sewn internally to the pair of shorts, it necessarily requires the athlete to slide a hand inside the pair of shorts in order to reposition the padding in the correct position.

As a partial solution to such drawbacks, it is also known to provide pairs of shorts which are made up of a support with which a uniform layer of additional material is associated, at the ischial, perineal and urogenital area and by way of perimetric stitching, which is contoured so as to define several mutually separate areas, which protrude from the support and are arranged laterally with respect to a longitudinal axis of the saddle; such protruding areas create zones, uniform in thickness but in different positions, for resting on.

While partially solving the above mentioned drawbacks, in such known art the paddings or the additional layer of material work by being deformed by the load pressing upon them, and they therefore define localized areas of pressure that generate further annoyances during the practice of sport.

Also the repositioning of such padding is difficult since, by being sewn internally to the pair of shorts, it necessarily requires the athlete to slide a hand inside the pair of shorts in order to reposition the padding in the correct position.

SUMMARY

The aim of the present disclosure is to eliminate the above mentioned drawbacks, by providing a device that, during use, enables the user to achieve an optimal level of comfort at the ischial, perineal and urogenital area and makes it possible to achieve a high freedom of movement.

Within this aim, the disclosure provides a device that makes it possible to achieve optimal level of comfort for the user even following a prolonged use thereof.

The disclosure also provides a device that is easily and effortlessly wearable by the user, that can be easily repositioned by the user during its use, and which can be used with any kind of shorts or skirt, without therefore requiring the use of technical pairs of shorts for cycling or motorcycling with inner padding.

The disclosure further provides a device that is structurally simple and which is not cumbersome and is easily transported.

The disclosure also provides a device that is low cost and which can be made with the usual conventional systems.

This aim and these and other advantages which will become better apparent hereinafter are achieved by providing a protection device for the ischial, perineal and urogenital area of a user, characterized in that it comprises:

- a folding main body, which is shaped substantially like a parallelogram and the internal surface of which is stably associated with multiple paddings which are separated by a plurality of dividing segments,
- two elastically extendable straps, which are stably associated at a first end thereof with said main body,
- at least one means for temporary interconnection, which is associated detachably with a second end of one of said straps.

BRIEF DESCRIPTION OF THE DRAWINGS

Further characteristics and advantages of the disclosure will become better apparent from the detailed description of a particular but not exclusive embodiment thereof, illustrated by way of non-limiting example in the accompanying drawings, wherein:

FIG. 4 is a cross-sectional view of the device taken along the line IV-IV of FIG. 1;

FIG. 5 is a cross-sectional view of the device taken along the line V-V of FIG. 1;

FIG. 6 is a front elevation view of the means for temporary interconnection;

DETAILED DESCRIPTION OF THE DRAWINGS

Figures 1, 2, 3:
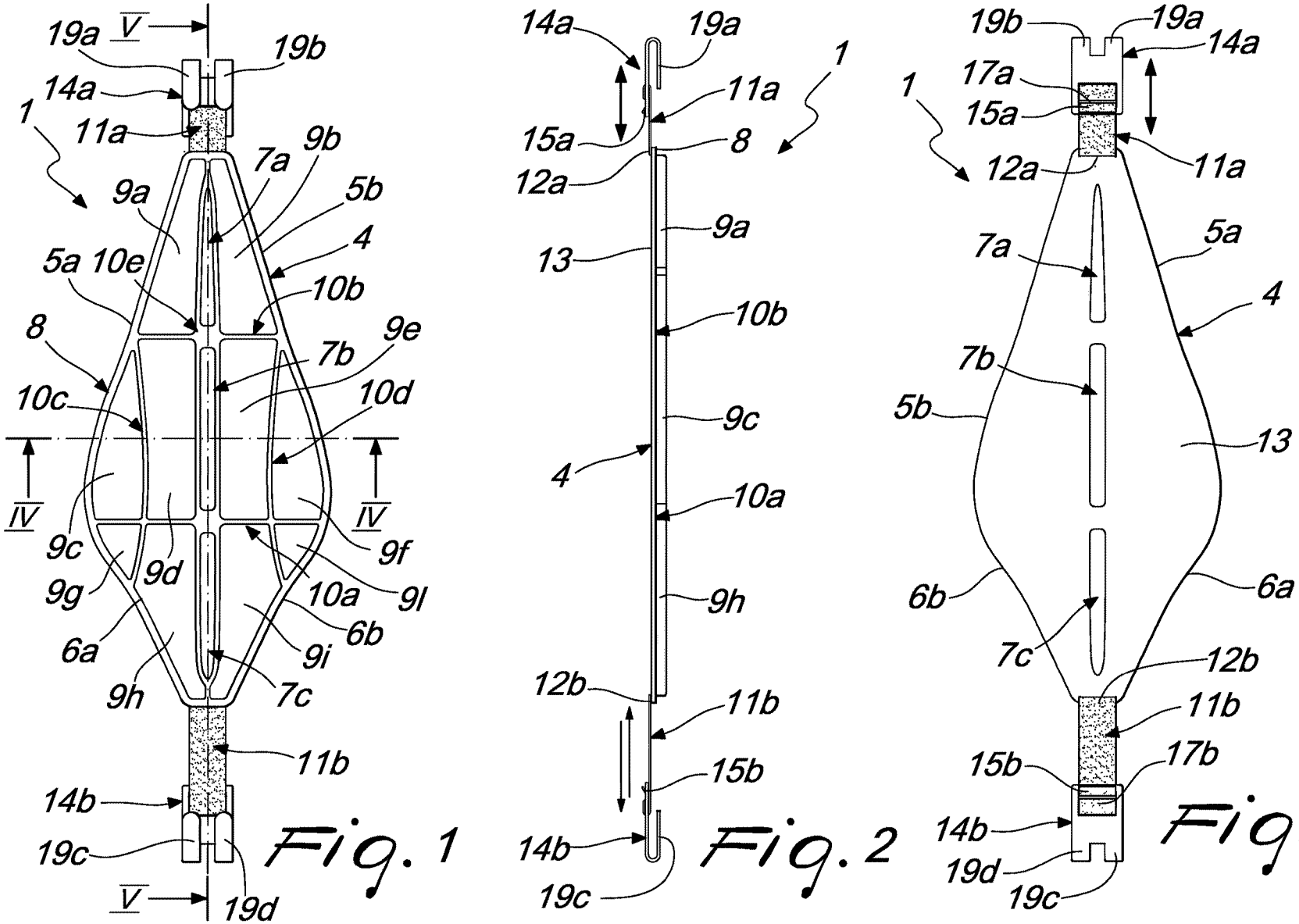
FIG. 1 is a view from above of the device according to the disclosure.
FIG. 2 is a side view of the device.
FIG. 3 is a view from below of the device.
Figure 8:
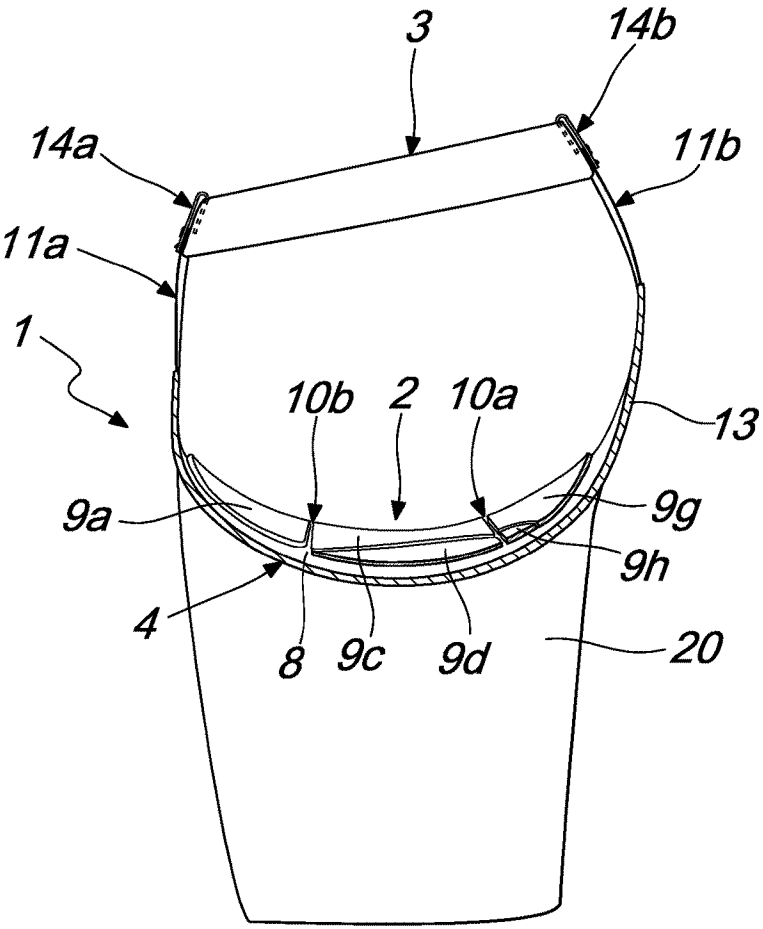
FIG. 8 is a cross-sectional view of the device, worn by the user, taken along the line VIII-VIII of FIG. 7.
Figure 7:
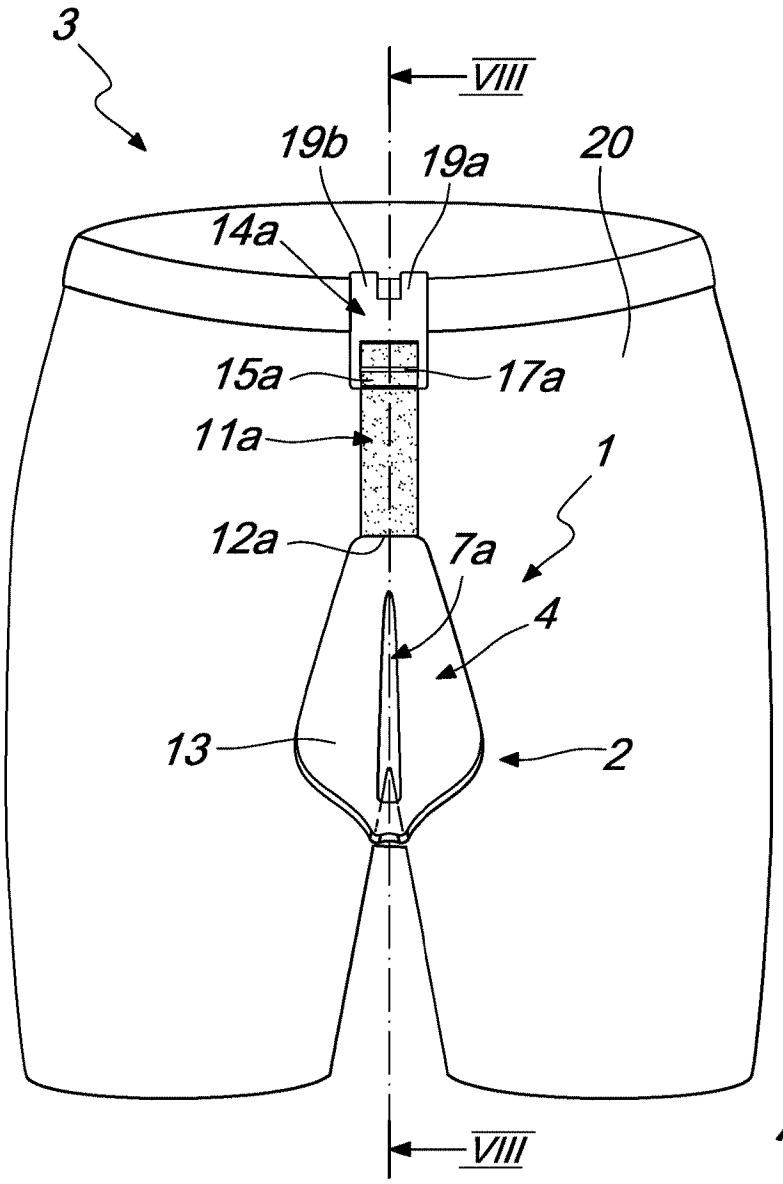
FIG. 7 is a front elevation view of the device, worn by a user.

In the exemplary embodiments that follow, individual characteristics, given in relation to specific examples, may actually be interchanged with other different characteristics that exist in other exemplary embodiments.

Moreover, it should be noted that anything found to be already known during the patenting process is understood not to be claimed and to be the subject of a disclaimer.

With reference to the figures, the reference numeral 1 designates a protection device for the ischial, perineal and urogenital area 2 of a user 3, which is particularly adapted for sports, urban and/or tourism use such as, for example, cycling, mountain biking, motorcycling or even for other activities such as gymnastics, spinning, triathlon, the protection device being adapted for any type of saddle, seat, and chair, including for example of the type used in aircraft or in cars or, in general, in vehicles.

The protection device 1 is preferably made with a material that is elastic or semi-elastic in all directions or which comprises rigid elements, or optionally made with material that is perforated internally in order to improve its breathability.

The protection device 1 comprises a main body 4, perforated, heat-breathable and optionally cold-thermoperforated or hot-thermoperforated or high frequency or optionally made with 3D printing, which is substantially shaped like a parallelogram or a rhomboid, has a vertical major diagonal which intersects, approximately two-thirds along its length, a horizontal minor diagonal.

The main body 4 therefore has two adjacent longer sides 5*a*, 5*b* of equal length, and two adjacent shorter sides 6*a*, 6*b* of equal length.

The corners of the main body 4 are rounded.

On the main body 4, at the major diagonal, first, second and third slots 7*a*, 7*b*, 7*c* are provided which are arranged in sequence in order to create better comfort for a male user.

The first slot 7*a* is substantially shaped like an isosceles triangle, with rounded corners, and is provided between the two longer sides 5*a*, 5*b* and is shorter than the second and third slots 7*b*, 7*c*.

The second slot 7*b* has a substantially rectangular shape, with rounded corners, and is provided between the two longer sides 5*a*, 5*b* and is longer than the first and third slots 7*a*, 7*c*.

The third slot 7*c* is substantially shaped like an isosceles triangle, with rounded corners, and is provided between the two shorter sides 6*a*, 6*b* and is longer than the first slot 7*a* and shorter than the second slot 7*b*.

In an embodiment not shown in the present application, the first slot 7*a* is not perforated and therefore on the main body 4 there are, at the major diagonal, only the second and third slots 7*b*, 7*c*, in order to create better comfort for a female user.

On the internal surface 8 of the main body 4 there is a plurality of paddings 9*a*, 9*b*, 9*c*, 9*d*, 9*e*, 9*f*, 9*g*, 9*h*, 9*i*, 91, perforated, and/or heat-breathable and optionally cold-thermoperforated or hot-thermoperforated or high frequency or optionally made with 3D printing, which are stably associated with the internal surface 8 and are adapted to cover it substantially over its entire surface.

The paddings 9*a*, 9*b*, 9*c*, 9*d*, 9*e*, 9*f*, 9*g*, 9*h*, 9*i*, 91 are mutually separated by means of five dividing segments 10*a*, 10*b*, 10*c*, 10*d*, 10*e* which follow the human anatomy, appreciably improving the wearability of the protection device 1 proper.

The first dividing segment 10*a* is arranged substantially proximate to the minor diagonal, the second dividing segment 10*b* is parallel to the previous one and adjacent to the first slot 7*a*, the third and the fourth dividing segments 10*c*, 10*d* are substantially vertical and connecting the two longer sides 5*a*, 5*b* with the two shorter sides 6*a*, 6*b* and the fifth dividing segment 10*e* encompasses the first, second and third slots 7*a*, 7*b*, 7*c*.

The dividing segments 10*a*, 10*b*, 10*c*, 10*d*, 10*e* are adapted to allow the main body 4 to be folded along substantially horizontal and vertical axes in order to limit the space occupation of the protection device 1 in order for it to be transported, while it is not in use.

The protection device 1 further comprises two elastically extendable straps 11*a*, 11*b* which are arranged at the same longitudinal axis and at the opposite ends of the major diagonal of the main body 4, the straps being stably associated, at a first end 12*a*, 12*b* thereof, with the main body 4, preferably at its external surface 13.

The two straps 11*a*, 11*b* are substantially rectangular in cross-section.

The protection device 1 further comprises two means for temporary interconnection 14*a*, 14*b*, such as two conventional clips or a magnetic front double-hook of the type used in conventional Bermuda shorts, which are associated detachably with a free second end 15*a*, 15*b* of the two straps 11*a*, 11*b*, which is opposite with respect to the first end 12*a*, 12*b*.

Each clip 14*a*, 14*b*, substantially rectangular in shape, has a laminar body on which are provided horizontally a first opening 16, at which the free second end 15*a*, 15*b* of the respective strap 11*a*, 11*b* can be inserted, and an adjacent second opening, at which a horizontal partition 17*a*, 17*b* is arranged in a central region and is adapted to define a first and a second seat 18*a*, 18*b* for the removable insertion of the free second end 15*a*, 15*b* of the two straps 11*a*, 11*b*.

Each strap 11*a*, 11*b* is coupled to the clip 14*a*, 14*b* as follows: the strap 11*a*, 11*b* is inserted into the first opening 16, is subsequently inserted into the second seat 18*b* and, passing under the partition 17*a*, 17*b*, is then inserted into the first seat 18*a*.

Each of the two clips 14*a*, 14*b* has, at the end directed in the opposite direction with respect to the two straps 11*a*, 11*b*, two teeth 19*a*, 19*b*, 19*c*, 19*d*, which protrude externally, are arranged parallel to each other, and are substantially C-shaped in cross-section, adapted to form a hook.

In a particular embodiment of the protection device 1, it is possible to have adapted non-slip inserts, which are stably associated or associable at the external surface 13 of the main body 4, and are adapted to provide an optimal stability of the protection device 1.

Furthermore, in a particular embodiment, the external surface 13 of the main body 4 of the protection device 1 can have reflective characteristics adapted to enable the immediate identification of the user 3 during nighttime use.

In use, the protection device 1 is adapted to be positioned by placing the main body 4 in the ischial, perineal and urogenital area 2 of a user 3, outside the items of clothing or shorts 20 of the user, and is stably associated thereat by coupling the teeth 18*a*, 18*b*, 18*c*, 18*d* of the clip 14*a*, 14*b* for example to the edges of the items of clothing or shorts 19 of the user 3 at the waist of the user 3.

Figure 10:
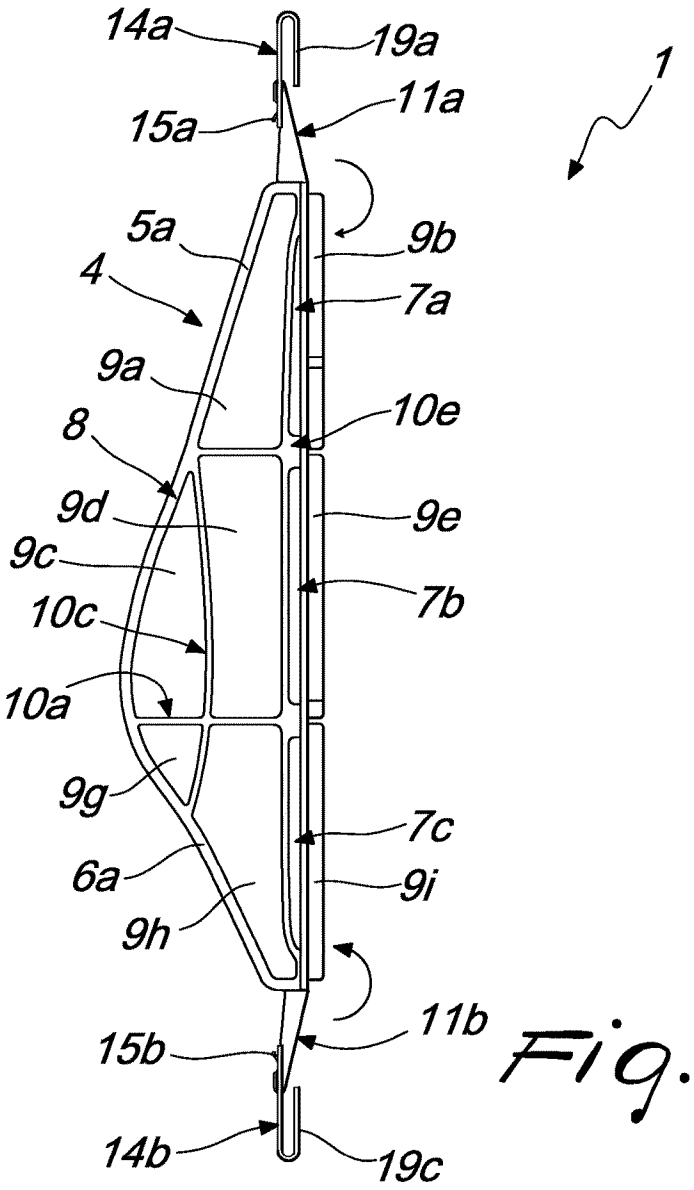
FIGS. 10, 11, 12, 13, 14, 15 and 16 show the steps of folding the device.
Figure 9:
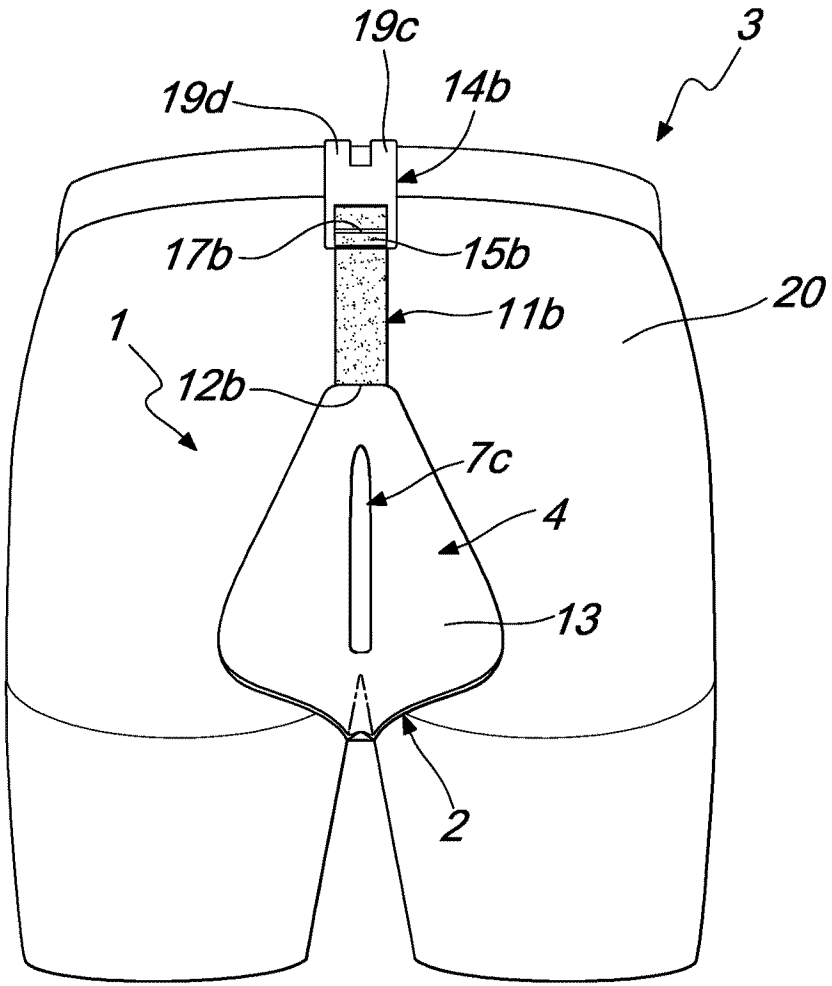
FIG. 9 is a rear view of the device, worn by a user.
Figure 13:
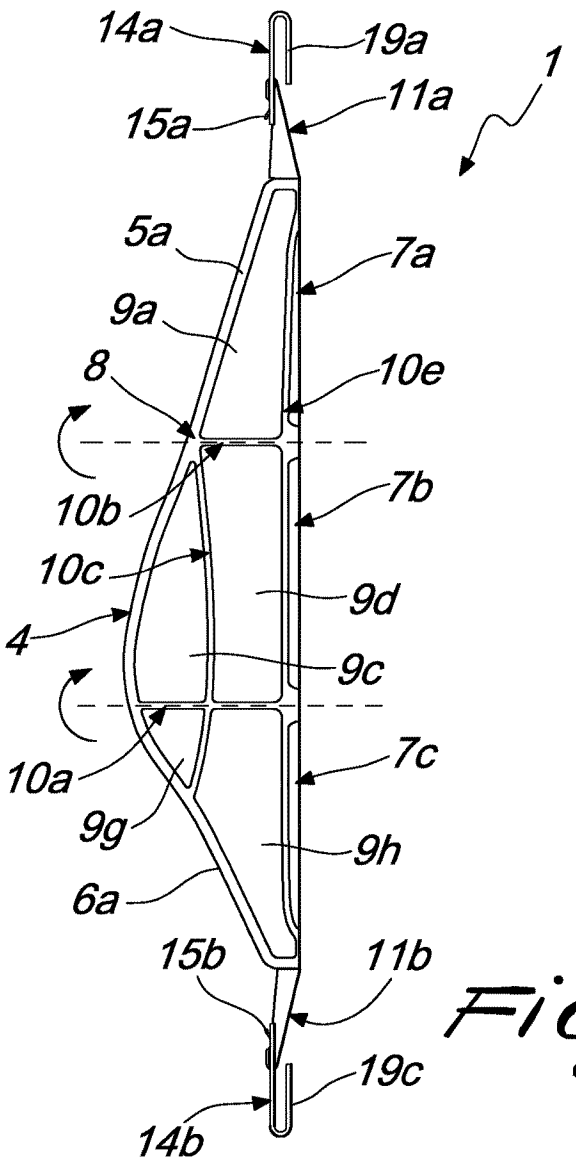
Figure 12:
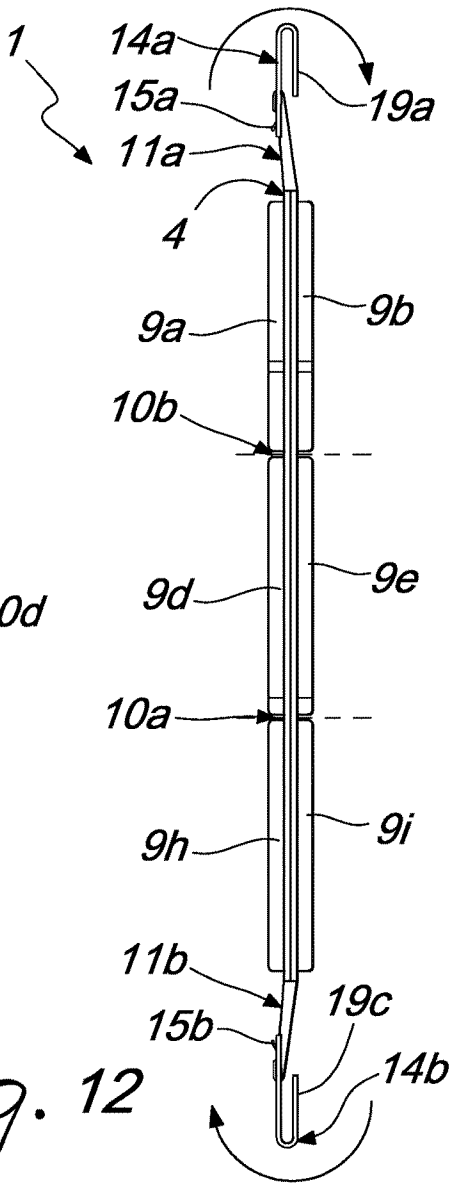
Figure 11:
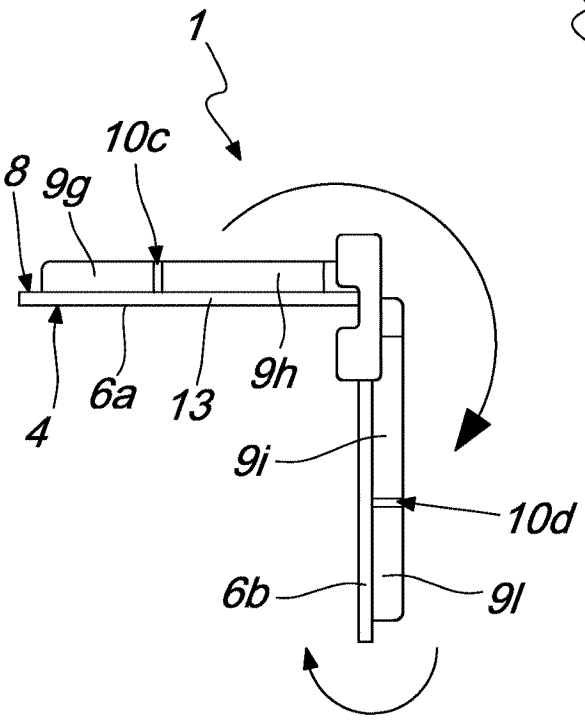
Figure 14:
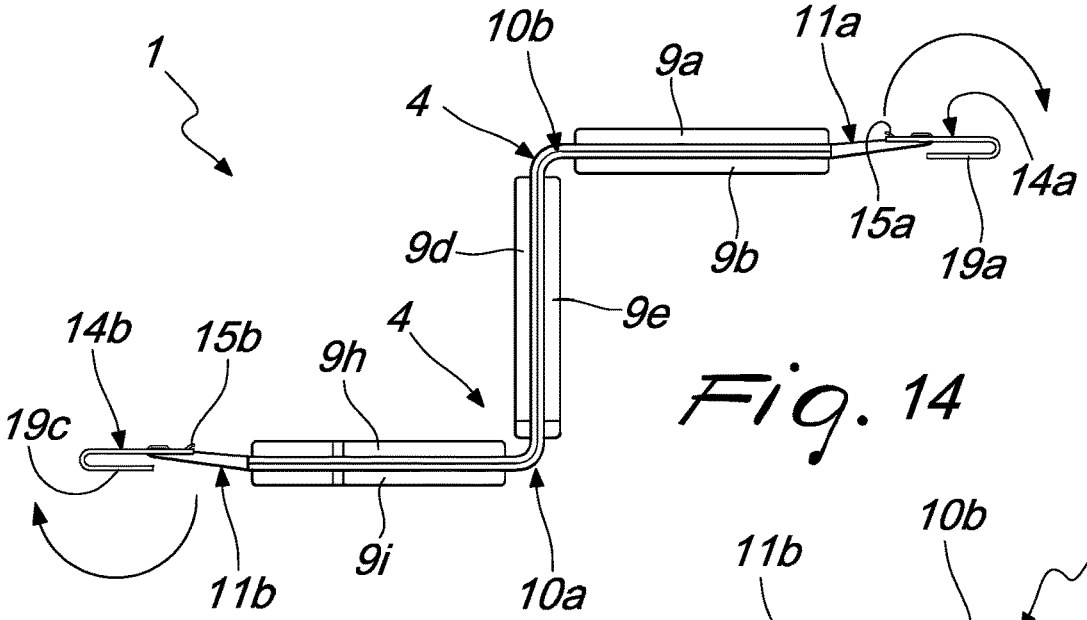
Figure 15:
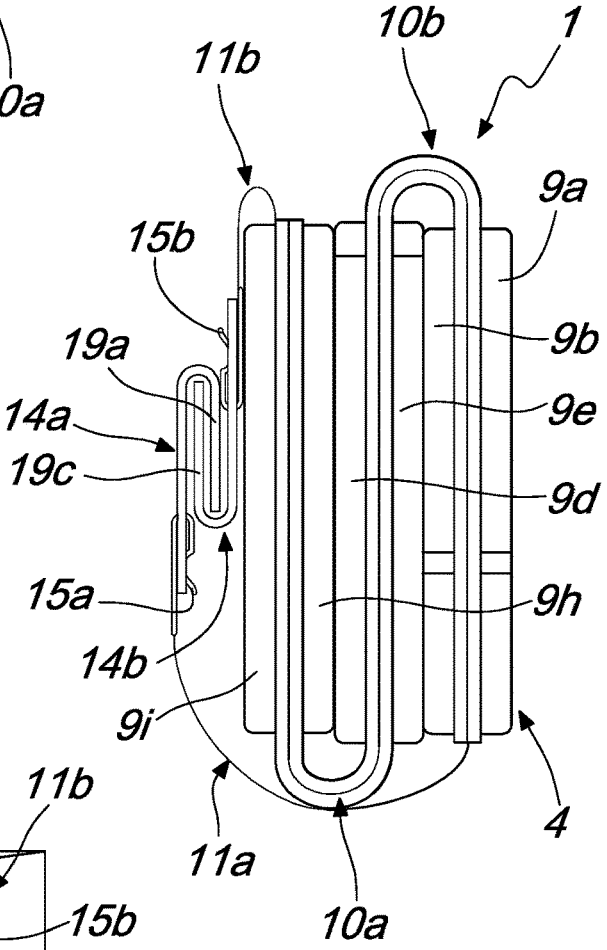
Figure 16:
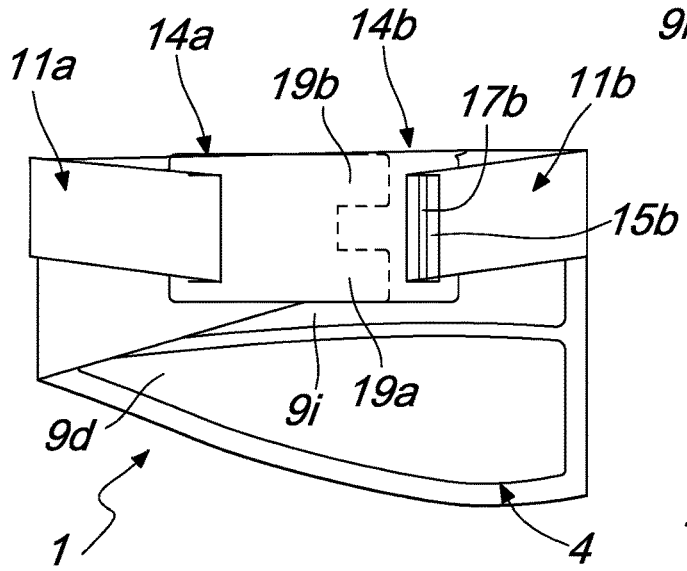

FIGS. 9 to 15 show the steps that make it possible to obtain the folding of the protection device 1 and these are described below.

Initially the main body 4 is folded, substantially at one hundred and eighty degrees clockwise, at the fifth dividing segment 10*e*, and then at the major diagonal of the main body 4, so that the longer sides 5*a*, 5*b* and the shorter sides 6*a*, 6*b* are brought into mutual contact.

Subsequently the main body 4 is folded, at the second dividing segment 10*b*, substantially at one hundred and eighty degrees clockwise and is then folded, at the first dividing segment 10*a*, substantially at one hundred and eighty degrees anticlockwise, in such a way that the main body 4, thus folded, assumes a sandwich shape structure with three superimposed layers.

Finally the clips 14*a*, 14*b* are coupled to each other, by coupling the teeth 18*a*, 18*b* of the clip 14*a* with the teeth 18*c*, 18*d* of the clip 14*b* in order to maintain the superimposed layers of the main body 4 in position.

Thus it has been found that the disclosure fully achieves the intended aim and objects, a protection device 1 having been obtained that enables the user 3 to achieve both a passive protection from pain in the event of a fall, and also an active protection by providing a benefit or relief therefore entailing an optimal comfort at the ischial, perineal and urogenital area 2 even for prolonged periods of use by virtue of the presence of the plurality of paddings 9*a*, 9*b*, 9*c*, 9*d*, 9*e*, 9*f*, 9*g*, 9*h*, 9*i*, 91, which are adapted to substantially cover the entire internal surface 8 of the main body 4.

It has further been found that the protection device 1 can be easily and effortlessly donned by the user 3 in just a few seconds over the items of clothing or shorts 19 by means of the clips 14*a*, 14*b* which are adapted to be selectively associable with the items of clothing or shorts 19 of the user 3.

It has therefore been found that the protection device can be used with any kind of shorts or skirt, without therefore requiring the use of technical pairs of shorts for cycling or motorcycling with inner padding but performing the same function as those garments.

Furthermore it has been found that the protection device 1 makes it possible to be easily repositioned by the user 3 during its use, it being located outside items of clothing or pairs of shorts 19.

Finally it has been found that the protection device 1 is structurally simple and not cumbersome and is easily transported, by virtue of the fact that the main body 4 can be folded.

The disclosure is susceptible of numerous modifications and variations, all of which are within the scope of the appended claims.

Naturally the materials used as well as the dimensions of the individual components of the disclosure may be more relevant according to specific requirements.

The characteristics indicated above as advantageous, convenient or the like, may also be missing or be substituted by equivalent characteristics.

The disclosures in Italian Patent Application No. 102017000076430 from which this application claims priority are incorporated herein by reference.

The invention claimed is:

1. A protection device for an ischial, perineal, and urogenital area of a user, the protection device comprising:

a folding main body, which is shaped like a parallelogram or rhomboid with rounded corners and having an internal surface that is coupled with a plurality of paddings separated by a plurality of dividing segments;

two elastically extendable straps coupled at a first end of each strap with said main body; and at least one means for temporary interconnection coupled with a second end of one of said straps, wherein said main body, which is shaped like a parallelogram or rhomboid with rounded corners, has a first diagonal intersecting, approximately two-thirds along a length of said main body, a second diagonal, said main body having two adjacent longer sides of equal length and two adjacent shorter sides of equal length, said main body having rounded corners, wherein a first slot, a second slot, and a third slot are arranged in sequence and provided at the first diagonal on said main body, said first slot being shaped like an isosceles triangle, with rounded corners, and being provided between said two longer sides, and being shorter than said second and third slots.

2. The protection device according to claim 1, wherein said second slot is shaped like a rectangle with rounded corners, and is provided between said two longer sides and is longer than said first slot and said third slot.

3. The protection device according to claim 1, wherein said third slot is shaped like an isosceles triangle, with rounded corners, and is provided between said two shorter sides and is longer than said first slot and shorter than said second slot.

4. The protection device according to claim 1, wherein said plurality of paddings are at said internal surface of said main body and are coupled with said internal surface and are adapted to cover said internal surface over the entire surface of said internal surface, said paddings being mutually separated by said plurality of dividing segments, a first dividing segment of said plurality of dividing segments being arranged proximate to said second diagonal, a second dividing segment of said plurality of dividing segments being arranged parallel to said first dividing segment and adjacent to said first slot, a third dividing segment of said plurality of dividing segments and a fourth dividing segment of said plurality of dividing segments being vertical and connecting said two longer sides to said two shorter sides and a fifth dividing segment of said plurality of dividing segments encompassing said first slot and said second and third slots, said dividing segments being adapted to allow said main body to be folded along horizontal and vertical axes of said main body.

5. The protection device according to claim 1, wherein said two elastically extendable straps are arranged at a same longitudinal axis and at opposite ends of the first diagonal of said main body, said elastically extendable straps being coupled, at each of said first ends of said strap, with said main body, at an external surface of the main body, said two straps being rectangular in cross-section.

6. The protection device according to claim 1, wherein said at least one means for temporary interconnection are coupled detachably with said second end of said two straps, which is a free end and is opposite with respect to said first end.

7. The protection device according to claim 1, wherein each one of said means for temporary interconnection has, at a distal end of said one of said straps, two teeth which protrude externally, are arranged parallel to each other, and are C-shaped in cross-section, adapted to form a hook.

8. The protection device according to claim 1, wherein each one of said means for temporary interconnection has, at a distal end of said one of said straps, magnetic means for temporary coupling.

* * * * *